US010718295B2

(12) United States Patent
Dworschak et al.

(10) Patent No.: US 10,718,295 B2
(45) Date of Patent: Jul. 21, 2020

(54) CARBURETOR FOR THE COMBUSTION ENGINE IN A HANDHELD WORK APPARATUS, COMBUSTION ENGINE COMPRISING A CARBURETOR, AND METHOD FOR OPERATING A COMBUSTION ENGINE

(71) Applicant: Andreas Stihl AG & Co. KG, Waiblingen (DE)

(72) Inventors: Jan Dworschak, Waiblingen (DE); Jan Pawlowski, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/244,984

(22) Filed: Jan. 10, 2019

(65) Prior Publication Data

US 2019/0211778 A1 Jul. 11, 2019

(30) Foreign Application Priority Data

Jan. 10, 2018 (DE) ..... 10 2018 000 145

(51) Int. Cl.
*F02M 1/02* (2006.01)
*F02D 9/16* (2006.01)
(Continued)

(52) U.S. Cl.
CPC ..... *F02M 1/02* (2013.01); *F02B 33/04* (2013.01); *F02B 63/02* (2013.01); *F02D 9/16* (2013.01);
(Continued)

(58) Field of Classification Search
CPC ..... F02M 1/02; F02M 9/08; F02M 17/02; F02M 35/1017; F02M 35/10196; F02M 35/1019; F02B 33/04; F02B 63/02; F02B 2075/025; F02D 9/16; F02D 35/0084; F02D 2200/0404
(Continued)

(56) References Cited

U.S. PATENT DOCUMENTS 4,909,211 A 3/1990 Cook et al.
7,047,937 B2 5/2006 Frank et al.
(Continued)

FOREIGN PATENT DOCUMENTS

DE 10326313 A1 12/2004
DE 102013009668 A1 12/2014

*Primary Examiner* — George C Jin
*Assistant Examiner* — Yi-Kai Wang
(74) *Attorney, Agent, or Firm* — Walter Ottesen, P.A.

(57) ABSTRACT

A carburetor for the combustion engine in a handheld work apparatus has a carburetor housing in which a carburetor drum is mounted rotatably about a pivot axis. The carburetor drum has a drum body which has at least one channel which runs transversely with respect to the pivot axis and forms an intake channel portion. A sensing unit for sensing at least one rotational position of the carburetor drum is provided. The sensing unit includes a control contour and a sensing device interacting with the control contour. The control contour is formed on the carburetor drum. A method for operating a combustion engine makes provision for the control device to control the supplied quantity of fuel depending on the rotational position, sensed by the sensing unit, of the carburetor drum.

14 Claims, 6 Drawing Sheets

(51) Int. Cl.

| | |
|---|---|
| ***F02D 35/00*** | (2006.01) |
| ***F02M 9/08*** | (2006.01) |
| ***F02B 33/04*** | (2006.01) |
| ***F02B 63/02*** | (2006.01) |
| ***F02M 17/02*** | (2006.01) |
| ***F02M 35/10*** | (2006.01) |
| *F02B 75/02* | (2006.01) |

(52) U.S. Cl.
CPC ..... *F02D 35/0084* (2013.01); *F02M 9/08* (2013.01); *F02M 17/02* (2013.01); *F02M 35/1017* (2013.01); *F02M 35/10196* (2013.01); *F02B 2075/025* (2013.01); *F02D 2200/0404* (2013.01); *F02M 35/1019* (2013.01)

(58) Field of Classification Search
USPC ..... 123/184.46
See application file for complete search history.

(56) References Cited

U.S. PATENT DOCUMENTS

| | | | | |
|---|---|---|---|---|
| 9,512,806 | B2 | 12/2016 | Osburg | |
| 2002/0121710 | A1* | 9/2002 | King | F02M 1/02 261/52 |
| 2004/0244769 | A1 | 12/2004 | Frank et al. | |
| 2010/0180861 | A1* | 7/2010 | Doering | F02M 1/02 123/337 |
| 2014/0360466 | A1* | 12/2014 | Osburg | F02M 1/02 123/403 |

* cited by examiner

CARBURETOR FOR THE COMBUSTION ENGINE IN A HANDHELD WORK APPARATUS, COMBUSTION ENGINE COMPRISING A CARBURETOR, AND METHOD FOR OPERATING A COMBUSTION ENGINE

CROSS REFERENCE TO RELATED APPLICATION

This application claims priority of German patent application no. 10 2018 000 145.9, filed Jan. 10, 2018, the entire content of which is incorporated herein by reference.

FIELD OF THE INVENTION

The invention relates to a carburetor for the combustion engine in a handheld work apparatus, to a combustion engine having a carburetor, and to a method for operating a combustion engine.

BACKGROUND OF THE INVENTION

U.S. Pat. No. 4,909,211 A discloses a carburetor having a carburetor drum. In order to sense the rotational position, a rotational position transmitter which is not described specifically is arranged at one end of the carburetor drum.

SUMMARY OF THE INVENTION

It is an object of the invention to provide a carburetor which is simply constructed and permits precise sensing at least of a rotational position of the carburetor drum.

This object can, for example, be achieved via a carburetor for the combustion engine in a handheld work apparatus. The carburetor includes: a carburetor housing; a carburetor drum mounted rotatably about a pivot axis in the carburetor housing; the carburetor drum having a drum body; the drum body having at least one channel which runs transversely with respect to the pivot axis and forms an intake channel portion; a sensing unit for sensing at least one rotational position of the carburetor drum; the sensing unit including a control contour and a sensing device configured to interact with the control contour; and, the control contour being formed on the carburetor drum.

It is a further object of the invention to provide a combustion engine having a carburetor.

This object can, for example, be achieved via a combustion engine including: a carburetor having a carburetor housing and a carburetor drum mounted rotatably about a pivot axis in the carburetor housing; the carburetor drum having a drum body; the drum body having at least one channel which runs transversely with respect to the pivot axis and forms an intake channel portion; the carburetor including a sensing unit for sensing at least one rotational position of the carburetor drum; the sensing unit including a control contour and a sensing device configured to interact with the control contour; the control contour being formed on the carburetor drum; a fuel valve via which fuel is fed into the channel of the carburetor drum; and, a control device connected to the sensing unit and to the fuel valve for feeding fuel into the intake channel portion.

It is a further object of the invention to provide a method for operating a combustion engine.

This object can, for example, be achieved via a method for operating a combustion engine having a carburetor, the carburetor having a carburetor housing and a carburetor drum mounted rotatably about a pivot axis in the carburetor housing, the carburetor drum having a drum body, the drum body having at least one channel which runs transversely with respect to the pivot axis and forms an intake channel portion, the carburetor including a sensing unit for sensing at least one rotational position of the carburetor drum, the sensing unit including a control contour and a sensing device interacting with the control contour, the control contour being formed on the carburetor drum, the carburetor further having a fuel valve via which fuel is fed into the channel of the carburetor drum, the combustion engine having a control device which is connected to the sensing unit and to the fuel valve for feeding fuel into the intake channel portion. The method includes the steps of: sensing a rotational position of the carburetor drum via the sensing unit; and, controlling, via the control device, a supplied quantity of fuel in dependence upon the rotational position of the carburetor drum sensed by the sensing unit.

It is provided that the sensing unit includes a control contour and a sensing device interacting with the control contour, and that the control contour is formed directly on the carburetor drum. By arranging the control contour on the carburetor drum, tolerances between the position of the control contour and the position of the carburetor drum can be minimized. A control contour can be introduced into the carburetor drum in a simple manner during the production of the carburetor drum. A control contour here is a contour which can be scanned mechanically, for example an elevation or depression on the outer periphery of the carburetor drum. A control contour can be simply produced by mechanical machining of the carburetor drum. In order to sense the rotational position of the carburetor drum, it is advantageously provided that, in different peripheral portions of the carburetor drum, the control contour is at different distances from the pivot axis of the carburetor drum, the distances being sensed by the sensing device. It is preferably provided that the sensing device scans the control contour.

The sensing unit can be configured, for example, to produce an electrical signal. The signal produced by the sensing unit can be read in particular in an evaluation unit and can advantageously be used for controlling a fuel supply device. The evaluation unit can be, for example, a control apparatus of a combustion engine.

The control contour may preferably be arranged directly on the carburetor drum. The control contour can in particular be arranged on a top side of the carburetor drum. The control contour can in particular be formed integrally with that part of the carburetor drum which has the at least one channel running transversely with respect to the pivot axis. As a result, tolerances between the at least one channel and the control contour can be minimized.

The carburetor drum can advantageously be of multi-part configuration. In an advantageous manner, a first part of the carburetor drum has the control contour and a second part has the at least one channel. The first part and the second part can advantageously be connected fixedly to each other, in particular by welding, adhesive bonding or the like. The two parts are in particular connected to each other in an integrally bonded manner. As a result, the control contour and the at least one channel can be produced in a simple manner. The at least two parts of the carburetor drum can advantageously be composed of different materials. As a result, the control contour can be formed in one part from wear-resistant material, for example a plastic, and the at least one channel can be formed in a fuel-resistant material, for example metal or another plastic. The two parts can be precisely positioned with respect to each other during the manufacturing before the parts are fixedly connected to each other, and therefore small tolerances can be kept to.

The control contour is advantageously arranged on the drum body. As a result, the control contour can be formed at a comparatively large distance from the pivot axis of the drum body. Tolerances during the sensing of the rotational position of the carburetor drum are thereby minimized. The control contour can preferably be arranged in that region of the drum body which has the largest diameter. The control contour is advantageously formed in the drum body of the carburetor drum. In an advantageous configuration, the drum body of the carburetor drum is formed as a single part. In an advantageous alternative configuration, the drum body is constructed from two parts which are fixedly connected to each other.

The control contour can preferably include at least one depression on the periphery of the carburetor drum. The control contour advantageously includes at least one depression in the periphery of the drum body of the carburetor drum. In an advantageous configuration, the control contour includes a first depression which is assigned to idle running. In a configuration, the control contour includes a first depression which is assigned to idle running, and a second depression which is assigned to the full load. Accordingly, the idle running position can be determined via the control contour. Particularly advantageously, the idle running position and the full load position can be determined via the control contour. The partial load range provided between the idle running position and the full load position can be determined by a signal deviating from the idle running position and the full load position. As a result, the sensing of the position of all of the positions of the drum body that are important for controlling the combustion engine is possible via two switching states of the sensing unit. The differentiation between idle running position and full load position can be achieved by different signals in the idle running position and full load position, for example via depressions of differing depth for idle running position and full load position. In a configuration, the same signal is sensed in the idle running position and full load position by the sensing unit, and the differentiation between idle running position and full load position takes place via further information, in particular with reference to a rotational speed of the combustion engine.

The scanning of the control contour advantageously reacts to an operator-controlled element, for example a gas pedal, via which the operator adjusts the carburetor drum. In order to keep the forces exerted on the gas pedal by the sensing unit as small as possible, it is advantageously provided that at least one depression has a base bounding the depression in the radial direction. The base advantageously merges on at least one side, lying in the peripheral direction, with an incline into the outer peripheral surface of the carburetor drum. Via the incline, the forces exerted on the sensing device by the control contour during the transition from the depression into the outer peripheral surface of the carburetor drum can be kept small. The inclination of the incline is advantageously selected in such a manner that the sensing of the rotational position of the carburetor drum is sufficiently precisely possible, but at the same time small forces, which are advantageously scarcely noticed, if at all, by the operator, are exerted on the gas pedal by the incline. In a configuration, the base bounds the depression in the radially inner direction.

In an alternative configuration, it can be provided that the base of the depression merges with the incline into a curved surface segment. The surface segment is advantageously curved with one or more radii about the pivot axis of the drum body. The radii advantageously differ here from the distance of the base of the depression from the pivot axis, and therefore the surface segment and the base of the depression are formed with different radii. A further switching state of the sensing unit can be achieved via the curved surface segment. In particular, further rotational positions of the drum body can thereby be sensed. The curved surface segment can be a surface segment, the radius of which is smaller than that of the outer peripheral surface of the carburetor drum in order to permit the arrangement in a smaller construction space. In an alternative embodiment, the radius of the curved surface segment is larger than that of the outer peripheral surface. As a result, the accuracy of sensing the rotational position of the drum body can be increased.

The base of the depression advantageously bounds the depression on the side lying radially inward with respect to the pivot axis. In an advantageous configuration, the sensing device lies against the control contour radially outside the control contour with respect to the pivot axis. The sensing device is advantageously spring-loaded radially inward with respect to the pivot axis by a return spring. The sensing unit advantageously includes a switch which is actuated depending on the position of the sensing device. Sensing of at least two switching states can take place in a simple manner via a switch. An electrical signal generated by a switch can be further processed electronically in a simple manner, in particular by an electronic control device.

The sensing device can preferably be formed on a pivot lever which is mounted on the carburetor housing so as to be pivotable about a second pivot axis lying parallel to the pivot axis of the carburetor drum. In a configuration, the pivot lever is connected to ground via the return spring. The return spring is accordingly a contact spring via which electrical contact with the ground is produced. This results in a simple construction with few components. However, it can also be provided that different spring elements are used for producing the ground contact and for prestressing the pivot lever into its radially inner position.

A fuel valve via which fuel is fed into the intake channel is advantageously provided. The fuel valve can be activated on the basis of the sensing of at least one rotational position of the drum body, and the required quantity of fuel can be precisely metered. For a combustion engine having a carburetor with a fuel valve, it is provided that the combustion engine has a control device which is connected to the sensing unit and to the fuel valve for feeding fuel into the intake channel.

A method for operating a combustion engine advantageously makes provision for the control device to control the supplied quantity of fuel depending on the rotational position, sensed by the sensing unit, of the carburetor drum. Precise metering of fuel is thereby made possible, in particular if the entire quantity of fuel fed to the intake channel is metered via a single fuel valve. It can advantageously be provided to influence the control of the ignition of the combustion engine by sensing at least one rotational position of the carburetor drum.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
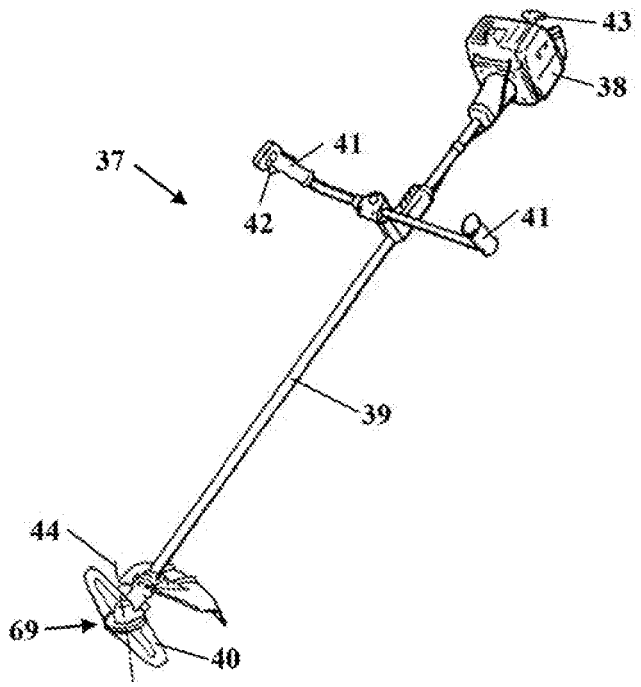
FIG. 1 is a schematic perspective illustration of a work apparatus.

FIG. 1 shows a brushcutter 37 as an embodiment for a handheld work apparatus. The brushcutter 37 has a housing 38 which is connected to a worktool head 69 via a guide tube 39. A tool 40, in the embodiment a cutting blade, is mounted rotatably about a rotational axis 44 on the worktool head 69. The tool 40 is driven by a combustion engine 1 which is arranged in the housing 38 and is shown schematically in FIG. 2. For starting the combustion engine 1, a starter device is provided, the starter handle 43 of which protrudes out of the housing 38, as FIG. 1 shows. In order to guide the brushcutter 1 during operation, handles 41 which are fixed on the guide tube 39 via a clamp are provided. At least one operator-controlled element 42 for activating the combustion engine 1 is arranged on one of the handles 41.

Figure 2:
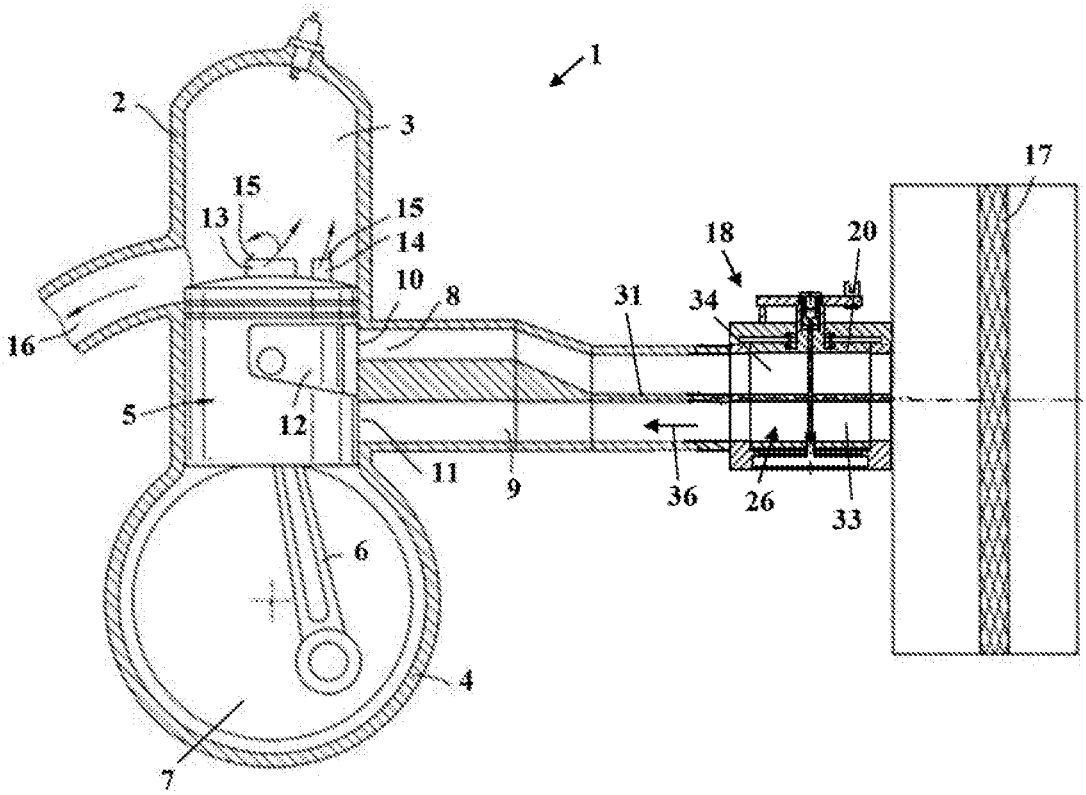
FIG. 2 is a schematic sectional illustration of a combustion engine of the work apparatus from FIG. 1.

FIG. 2 schematically shows the configuration of the combustion engine 1. In the embodiment, the combustion engine 1 is a two-stroke engine operating with a scavenging gas shield. A different configuration of the combustion engine 1, for example a configuration as a four-stroke engine, in particular as a mixture-lubricated four-stroke engine, may also be advantageous, however. The combustion engine 1 has a cylinder 2 in which a combustion chamber 3 is formed. The combustion chamber 3 is bounded by a piston 5 which is mounted in a reciprocating manner in the cylinder 2 and, via a connecting rod 6, drives a crankshaft 7 which is mounted rotatably in a crankcase 4. The combustion engine 1 includes an air filter 17 via which combustion air is sucked up during operation. The air filter 17 is connected via an intake channel 26 to an air intake 10 and to a mixture inlet 11 on the cylinder 2. Combustion air which has been sucked up and a fuel/air mixture flow in a flow direction 36 through the intake channel 26. The intake channel 26 is separated by a partition wall 31 into the first supply channel 8 for air and the second supply channel 9 for mixture. The combustion air is sucked up by a first supply channel 8, which is provided for supplying air, to at least one air intake 10 on the cylinder 2. In addition, combustion air is sucked up via a second supply channel 9, which is provided for supplying a fuel/air mixture, to a mixture inlet 11. The combustion engine 1 has outlet-near transfer channels 13 and inlet-near transfer channels 14 which open with transfer windows 15 at the cylinder bore. The transfer channels 13 and 14 connect the interior of the crankcase 4 to the combustion chamber 3 in the region of the lower dead center, which is shown in FIG. 2, of the piston 5.

The mixture inlet 11 and the air intake 10 are controlled by the piston skirt of the piston 5. The combustion engine 1 of the embodiment is a slot-controlled engine. The mixture inlet 11 is connected in the region of the upper dead center of the piston 5 to the interior of the crankcase 4. The air intake 10 opens in a region of the piston 5, in which a piston pocket 12 of the piston 5 moves. The piston pocket 12 connects the air intake 10 in the region of the upper dead center of the piston 5 to the transfer windows 15 of the outlet-near transfer channels 13 and the outlet-remote transfer channels 14. The illustration in FIG. 2 is merely schematic.

A carburetor 18 is provided for supplying fuel. The carburetor 18 has a carburetor drum 20. The carburetor drum 20 is mounted rotatably in order to control the supplied quantity of combustion air. A first channel 34 which forms an air channel portion and a second channel 33 which forms a mixture channel portion are formed in the carburetor drum 20. Alternatively, it can also be provided that only a mixture channel portion is provided in the carburetor drum 20.

During the operation of the combustion engine 1, a fuel/air mixture is sucked during the upward stroke of the piston 5 out of the second supply channel 9 via the mixture inlet 11 into the interior of the crankcase 4. As soon as the piston pockets 12 connect the at least one air intake 10 to the transfer windows 15, fuel-free or fuel-poor combustion air is sucked out of the first supply channel 8 via the transfer windows 15 into the transfer channels 13 and 14. During the subsequent downward stroke, that is, the movement of the piston 5 from the combustion chamber 3 in the direction of the crankcase 4, the fuel/air mixture in the interior of the crankcase 4 is compressed in the interior of the crankcase 4. As soon as the transfer windows 15 are opened by the downwardly moving piston 5, first of all fuel-free or fuel-poor air flows out of the transfer windows 15 into the combustion chamber 3. The fuel-poor or fuel-free combustion air flushes exhaust gases from the preceding engine cycle out of the combustion chamber 3 through an outlet 16 from the combustion chamber 3. Subsequently, a fresh mixture flows into the combustion chamber 3 from the interior of the crankcase 4. During the following upward stroke of the piston, the mixture in the combustion chamber 3 is compressed and ignited and burned in the region of the upper dead center of the piston 5. The burning causes the piston 5 to be accelerated again in the direction of the crankcase 4. As soon as the transfer windows 15 open, first of all air stored upstream flows out of the transfer channels 13 and 14 and subsequently a fresh mixture flows out of the interior of the crankcase 4 via the transfer channels 13 and 14 into the combustion chamber 3.

Figure 3:
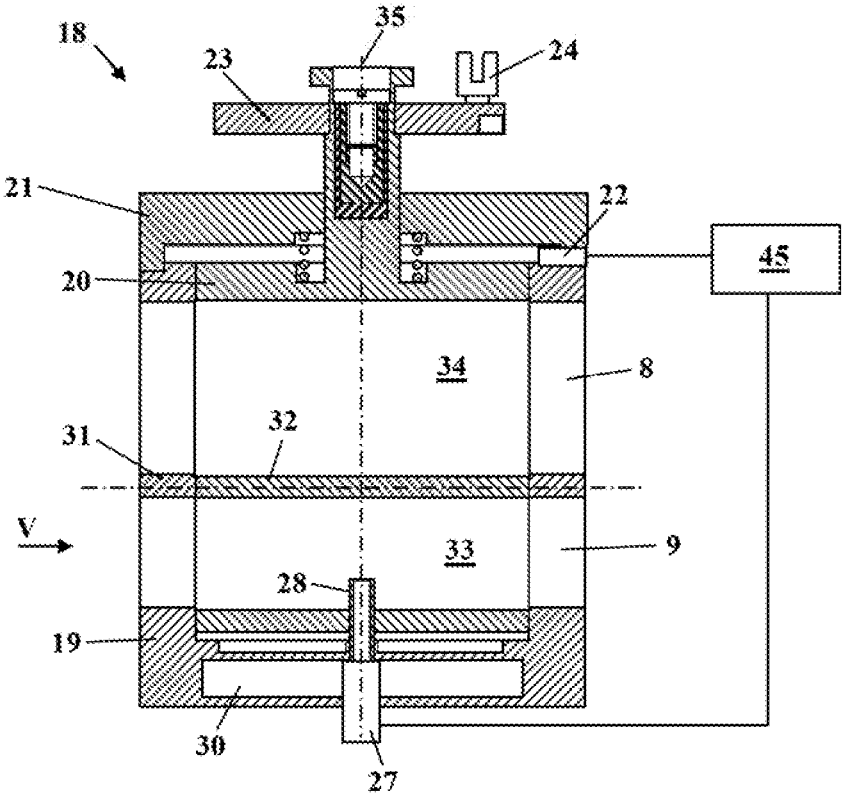
FIG. 3 is a schematic sectional illustration of the carburetor of the combustion engine from FIG. 2.

FIG. 3 shows the configuration of the carburetor 18 in detail. The carburetor 18 has a carburetor housing 19 which is closed by a cap 21. In the carburetor housing 19, the carburetor drum 20 is mounted pivotably about a pivot axis 35. An actuating lever 23 on which the operator-controlled element 42 (FIG. 1) of the work apparatus acts is fixed on the carburetor drum 20. The operator-controlled element 42 is advantageously connected via a Bowden cable or another transmission element to an actuating lug 24 fixed on the actuating lever 23. If the operator actuates the operator-controlled element 42, the carburetor drum 20 pivots in the carburetor housing 19 about the pivot axis 35.

As FIG. 3 shows, the channels 33 and 34 in the carburetor drum 20 are separated by a partition wall section 32 which lies flush in the partition wall 31. In order to supply fuel, a fuel opening 28 is provided which opens into the second channel 33 of the carburetor drum 20. In the embodiment, the fuel opening 28 is connected to a fuel chamber 30 via a fuel valve 27. The fuel valve 27 can preferably be configured as an electromagnetic valve and controls the entire quantity of fuel fed into the channel 33 via the fuel opening 28. The fuel opening 28 can advantageously be the sole fuel opening opening in the carburetor drum 20. The fuel valve 27 is activated by a control device 45. In order to sense the rotational position of the carburetor drum 20, a switch 22 is provided in the embodiment, the switch being shown schematically in FIG. 3 and the configuration of the switch being explained in more detail below. The switch 22 is connected to the control device 45.

In an alternative embodiment, it can be provided that, in order to control the supplied quantity of fuel, a control needle projects into the fuel opening 28 and the size of an annular gap formed between control needle and fuel opening changes depending on the rotational position of the carburetor drum 20. To change the size of the annular gap, it is known to provide a ramp between carburetor housing 19 and carburetor drum 20, via which ramp the carburetor drum 20 is moved in the direction of the pivot axis 35 during a pivoting movement about the pivot axis 35.

Figure 4:
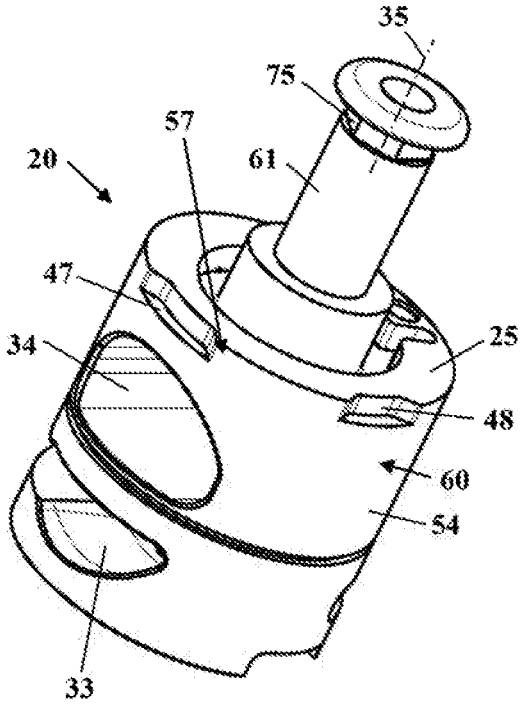
FIG. 4 is a perspective illustration of the carburetor drum of the carburetor from FIG. 3.
Figure 5:
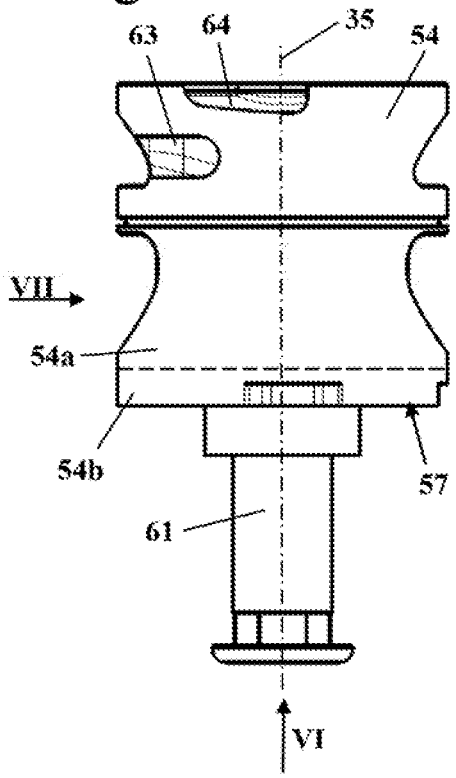
FIG. 5 shows a side view of the carburetor drum from FIG. 4.
Figure 6:
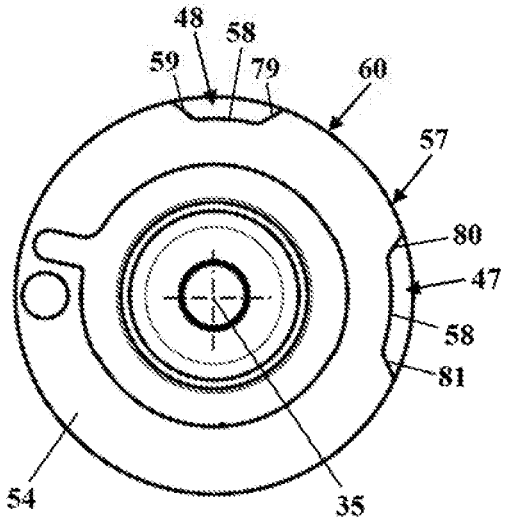
FIG. 6 shows a top view of the carburetor drum from FIG. 5 in the direction of the arrow VI in FIG. 5.

FIGS. 4 to 6 show the configuration of the carburetor drum 20 in detail. The carburetor drum 20 has a drum body 54 on which an outer peripheral surface 60 is formed. The outer peripheral surface 60 is that region of the carburetor drum 20 which has the largest diameter. A drum shaft 61 with a reduced diameter is advantageously fixed on the drum body 54. The drum body 54 is advantageously formed in one piece with the drum shaft 61. However, in an alternative configuration, a multi-part configuration, in particular a configuration including a plurality of parts connected fixedly and nonreleasably to one another may also be advantageous. The drum shaft 61 has an engagement contour 75 on which the actuating lever 23 (FIG. 2) is to be fixed for rotation therewith. The drum shaft 61 and the drum body 54 can preferably be of substantially cylindrical configuration, with the pivot axis 35 forming the longitudinal center axis of the drum body 54 and of the drum shaft 61. As FIG. 4 also shows, the channels 33 and 34 are configured as through openings, which run transversely with respect to the pivot axis 35, through the drum body 54. The drum body has a top side 25 from which the drum shaft 61 extends. The top side 25 is the end side of the drum body 54 that faces the drum shaft 61.

On that side of the drum body 54 that lies adjacent to the drum shaft 61, the drum body 54 has a control contour 57 on its outer periphery. The control contour 57 serves for sensing the rotational position of the carburetor drum 20 and actuates the switch 22 (FIG. 3). The control contour 57 can preferably be formed by at least one depression 47 or 48. In particular, the control contour 57 is formed by two depressions 47 and 48. The control contour 57 can preferably be formed by two depressions 47 and 48 and by a region of the outer peripheral surface 60 lying between the depressions 47 and 48. Instead of the outer peripheral surface 60, the region lying between the depressions 47 and 48 can also be formed by a further contour. The further contour is in particular a surface which is curved about the pivot axis 35 and runs at a different distance from the pivot axis 35 than the outer peripheral surface 60. In the embodiment, the control contour 57 extends as far as the top side 25. The depressions 47 and 48 are open toward the top side 25. In an alternative embodiment, the control contour 57 can also be at a distance from the top side 25.

As FIG. 5 shows, the drum body 54 has a positioning contour 64 on the end side remote from the drum shaft 61. The positioning contour 64 can be provided in order to change the position of the carburetor drum 20 in the direction of the pivot axis 35 depending on the rotational position of the carburetor drum 20, for example in order to adjust the supplied quantity of fuel via a needle projecting into the fuel opening 28 (FIG. 3). In the embodiment, the positioning contour 64 is unimportant since the quantity of fuel supplied via the fuel opening 28 is adjusted via the fuel valve 27.

FIG. 6 shows the configuration of the depressions 47 and 48 in detail. The two depressions 47 and 48 have a base 58 lying radially on the inside with respect to the pivot axis 35. In the embodiment shown in FIG. 6, those ends of the depressions 47 and 48 that lie in the peripheral direction merge on one side each with an incline 79, 80 into the outer peripheral surface 60. In an alternative configuration, elevations can be provided instead of the depressions 47 and 48. The elevations can preferably merge with inclines into the outer peripheral surface 60.

Figure 7:
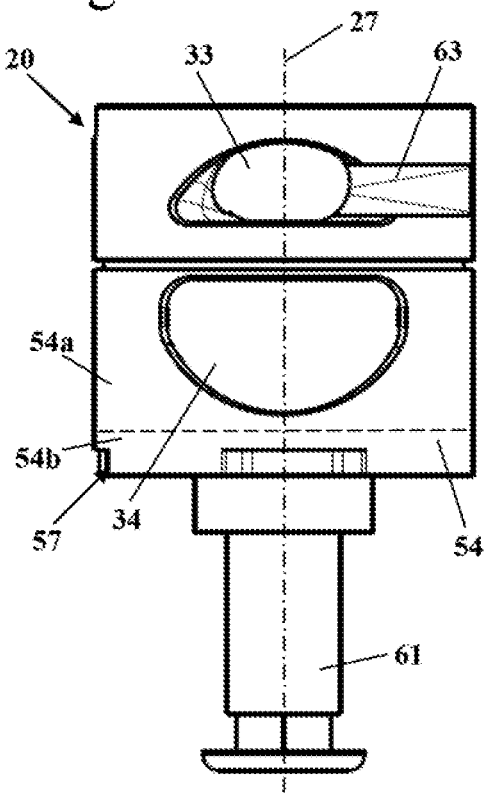
FIG. 7 shows a side view of the carburetor drum in the direction of the arrow VII in FIG. 5.

As FIG. 7 shows, a groove 63 running in the peripheral direction is provided on the channel 33. The channel 33 is preferably a mixture channel for guiding a fuel/air mixture. The mixture is formed in the drum body 54 preferably by fuel being supplied into the mixture channel. The groove 63 serves to already slightly open the mixture channel in the idle running position of the carburetor drum 20.

In the embodiment, the drum body 54 is configured as a single part. FIGS. 5 and 7 schematically illustrate a further advantageous variant configuration in which the drum body is constructed from two parts 54*a* and 54*b* connected to each other. The parts 54*a* and 54*b* are advantageously connected fixedly, in particular nonreleasably, to each other. However, a releasable connection of the two parts 54*a* and 54*b*, for example a screw connection, may also be advantageous. The part 54*a* is configured in the shape of a drum and has the channels 33 and 34. The part 54*a* is advantageously composed of media-resistant plastic or metal. In the embodiment, the part 54*b* is configured as a flat disk and has the control contour 57. The part 54*b* is advantageously composed of plastic. The material of the part 54*b* is advantageously coordinated with the material of the pivot lever 49 in such a manner that small frictional forces arise between control contour 57 and pivot lever 49. The parts 54*a* and 54*b* are in particular adjusted with respect to each other before being fixedly connected, in particular integrally bonded, to each other, and therefore small tolerances arise between the control contour 57 and the channels 33 and 34. Alternatively, the position of the parts 54*a* and 54*b* with respect to each other can also be structurally defined, for example via a stop or the like.

Figure 8:
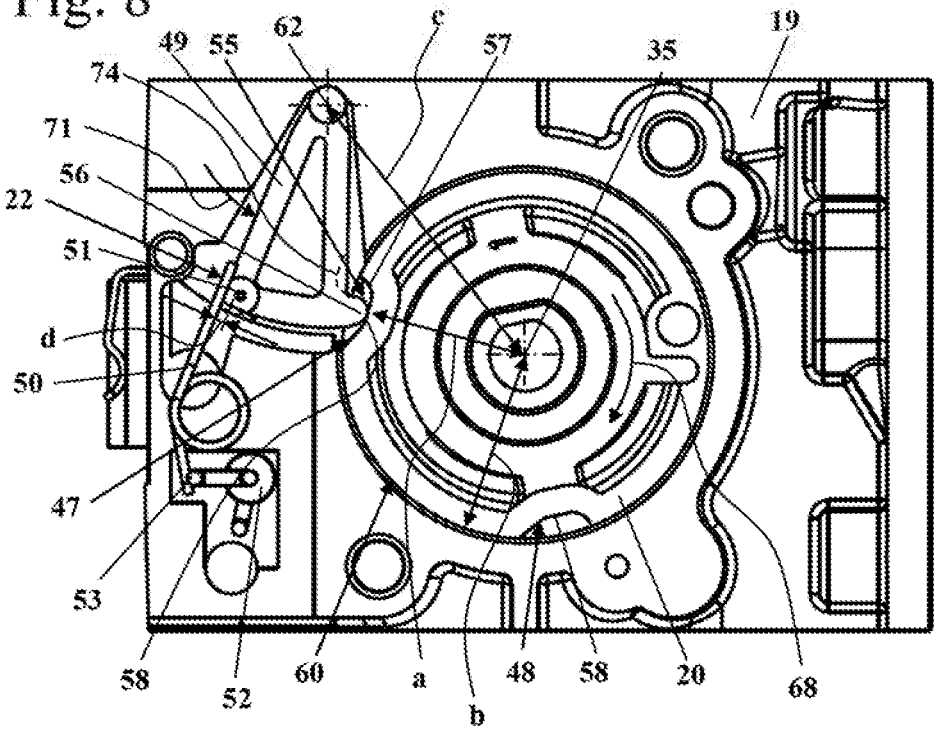
FIG. 8 shows a schematic top view of the carburetor with cap removed in the idle running position of an embodiment of the carburetor drum.

FIG. 8 shows the carburetor housing 19 with the carburetor drum 20 in a top view without cap 21 (see FIG. 3). As a result, the carburetor drum 20 and the switch 22 are visible.

A pivot lever 49 is advantageously mounted on the carburetor housing 19 so as to be pivotable about a pivot axis 62 of the pivot lever 49. The pivot axis 62 of the pivot lever 49 is arranged at a distance c from the pivot axis 35 of the carburetor drum 20. The distance c is advantageously greater than the distance b of the outer peripheral surface 60 from the pivot axis 35 of the carburetor drum 20. Accordingly, the pivot axis 62 of the pivot lever 49 lies outside the drum body 20. The pivot axis 62 of the pivot lever 49 can preferably be oriented parallel to the pivot axis 35 of the carburetor drum 20. The pivot lever 49 advantageously has a lug which lies against the carburetor drum 20 and forms a sensing device 56 for sensing the rotational position of the carburetor drum 20. The sensing device 56 together with the control contour 57 forms a sensing unit 55 for sensing the rotational position of the carburetor drum 20. As illustrated in FIG. 8 with a dashed line, the pivot lever 49 can have a cutout 74 adjacent to the sensing device 56, the cutout avoiding contact of this region of the pivot lever 49 with the outer peripheral surface 60.

In the idle running position shown of the carburetor drum 20, the sensing device 56 lies against the base 58 of the first depression 47. The base 58 is at a distance a from the pivot axis 35 of the carburetor drum 20, the distance being smaller than the distance b of the outer peripheral surface 60 from the pivot axis 35 of the carburetor drum 20. The pivot lever 49 is prestressed in the direction of that position of the sensing device 56 which lies radially on the inside with respect to the pivot axis 35 of the carburetor drum 20. The prestressing of the pivot lever 49 is indicated in FIG. 8 by an arrow 71. The prestressing of the pivot lever 49 can take place by means of a return spring 70 (FIG. 14) which is part of the switch 22. Alternatively, the prestressing can also be applied by a spring element separate from the switch 22. However, it can also be provided that the prestressing is applied in the direction of the arrow 71 by a separate spring element. Owing to the prestressing, the sensing device 56 lies against the base 58 of the depression 47.

A contact pin 51 which, together with the spring 50, forms the switch 22 is advantageously fixed on the pivot lever 49. In the switching position shown, the contact pin 51 is at a distance d from the spring 50, which is in the form of a contact spring. Accordingly, the contact pin 51 is not connected in an electrically conducting manner to the spring 50. The switch 22 is open. The spring 50 lies against a contact 53 of a diode 52 which is connected to the control device 45.

Figure 9:
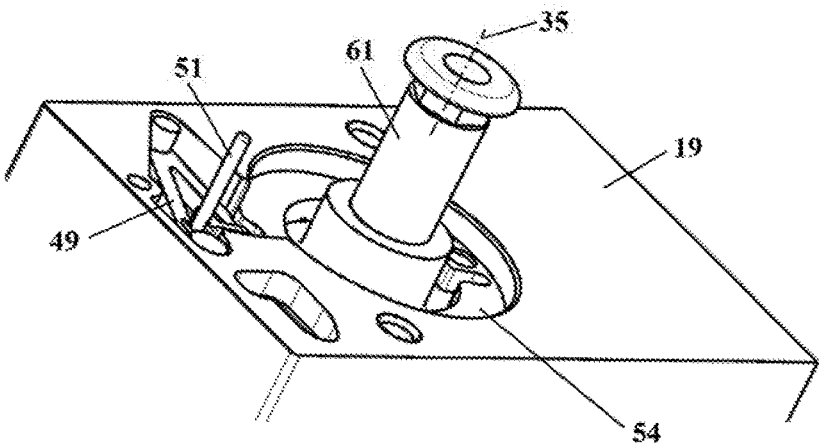
FIG. 9 is a schematic perspective illustration of pivot lever and carburetor drum in the switching position from FIG. 8.
Figure 10:
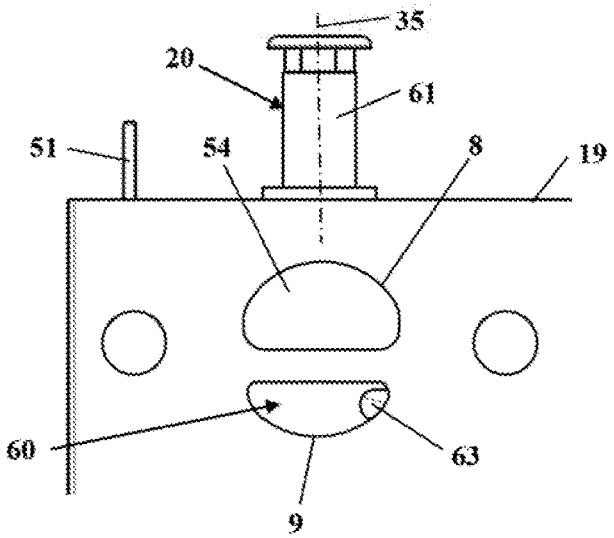
FIG. 10 shows a side view of the carburetor in the position from FIGS. 8 and 9.

As FIGS. 9 and 10 show, the contact pin 51 advantageously protrudes upward from the pivot lever 49 parallel to the pivot axis 35.

FIG. 10 shows an embodiment of a carburetor with a carburetor drum 20 in the idle running position. The idle running position refers to the operation of the combustion engine 1 during idle running, that is, when the combustion engine 1 is running without a user stepping on the gas, for example by means of an operator-controlled element 42 (FIG. 1). As FIG. 10 shows, the first supply channel 8 is completely closed in the idle running position of the carburetor drum 20. In the second supply channel 9 for a mixture, a small flow cross section is opened up via the groove 63. As a result, a small quantity of combustion air can flow through the second supply channel 9 and, in the process, can carry along fuel out of the fuel opening 28 (FIG. 2).

Figure 11:
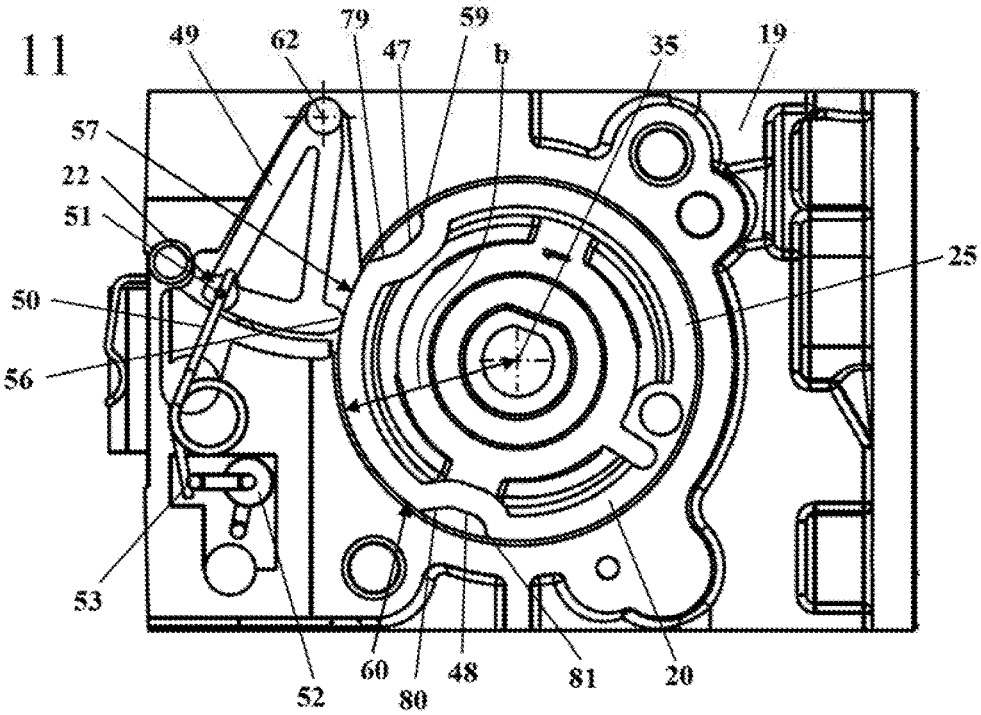
FIG. 11 shows a top view of the carburetor with cap removed together with the carburetor drum from FIG. 8 in a partial load position.
Figure 12:
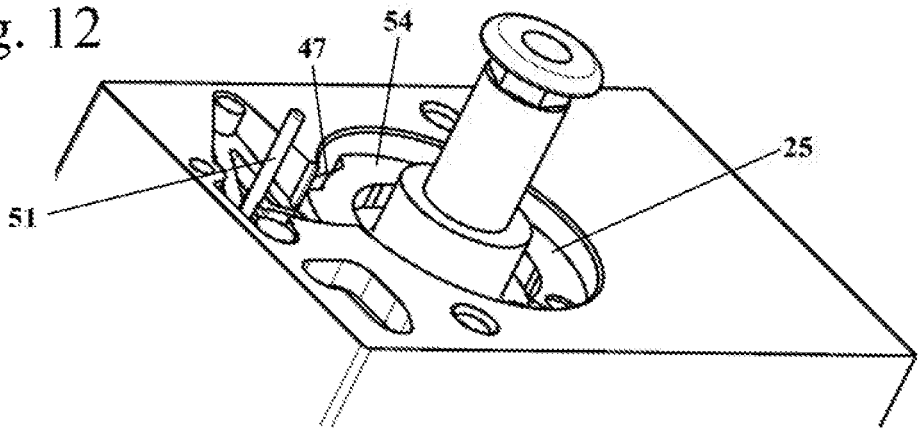
FIG. 12 is a perspective illustration of pivot lever and carburetor drum in the position from FIG. 11.
Figure 13:
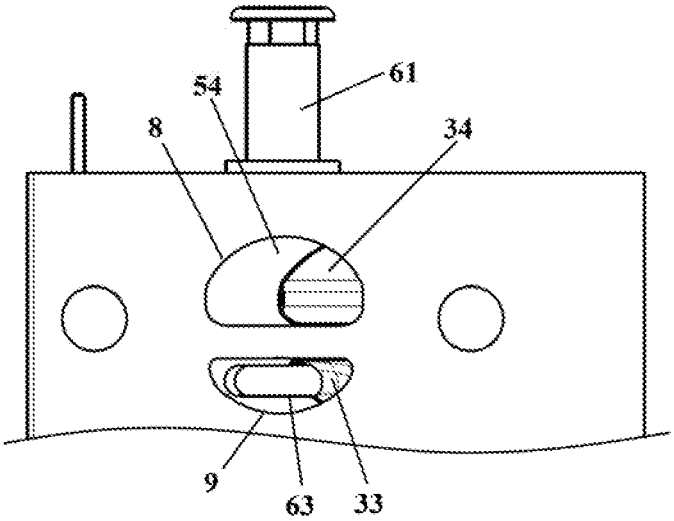
FIG. 13 shows a side view of the carburetor in the switching position from FIGS. 11 and 12.

If the carburetor drum 20 is rotated in the direction of the arrow 68, for example by pressing the operator-controlled element 42 (FIG. 1), such as a gas pedal, the drum body 20 passes into the partial load position shown in FIGS. 11 to 13. The sensing device 56 slides here from the base 58 via the incline 79 onto the outer peripheral surface 60. By means of the inclination of the incline 79, the forces exerted on the carburetor drum 20 and therefore on the operator-controlled element 42 by the pivot lever 49 are adjusted during the transition from the idle running position into the partial load position. By means of the inclination of the incline 80 of the depression 48, the forces exerted on the carburetor drum 20 and therefore on the operator-controlled element 42 by the pivot lever 49 are adjusted during the transition from the full load position into the partial load position. The inclination of the inclines 79 and 80 is advantageously selected in such a manner that the forces exerted on the carburetor drum 20 by the pivot lever 49 are as small as possible. While the sensing device 56 is located on an incline 79, 80, the switching state of the switch 22 is not defined. In order to be able to determine the rotational position of the carburetor drum 20 with little tolerance, the inclines 79 and 80 in the peripheral direction are advantageously short. As illustrated in FIG. 6, the depressions 47 and 48 can each have an incline 59 or 81 on the side over which the pivot lever 49 does not move from the partial load position into the idle running position or full load position. However, the depressions 47, 48 can also be formed without an incline on the side, as illustrated in FIG. 8.

FIGS. 11 to 13 show the arrangement with the carburetor drum 20 in a partial load position. As in particular FIG. 11 and FIG. 12 show, the depressions 47 and 48 also extend in the embodiment according to FIGS. 11 to 13 as far as the top side 25. The partial load position refers to the operation of the combustion engine 1 in partial load, that is, when the combustion engine 1 is running and a user steps on the gas, for example by means of an operator-controlled element 42 (FIG. 1). When the operator-controlled element 42 is completely depressed, a full gas position is present. In a partial load position, the carburetor drum 20 is located between the idle running position and the full gas position. As FIG. 13 shows, the first supply channel 8 and the second supply channel 9 are partially open in the partial load position. The sensing device 56, in the embodiment the lug of the pivot lever 49, has moved out of the first depression 47 along the incline 79 during the rotational movement of the carburetor drum 20 and now lies against the outer peripheral surface 60. The sensing unit 56 lies at the distance b from the pivot axis 35, that is, has been moved radially outward with respect to the pivot axis 35. As a result, the pivot lever 49 has been pivoted about the pivot axis 62. The contact pin 51 has correspondingly moved about the pivot axis 62 and now lies against the spring 50. The switch 22 formed by the contact pin 51 and the spring 50 is closed. The contact pin 51 is electrically conductively connected to the contact 53 of the diode 52 via the spring 50. The control device 45 thereby obtains a signal which indicates that the carburetor drum 20 is in a partial load position. As FIG. 13 shows, the first supply channel 8 and the second supply channel 9 are partially open in the partial load position.

Figure 14:
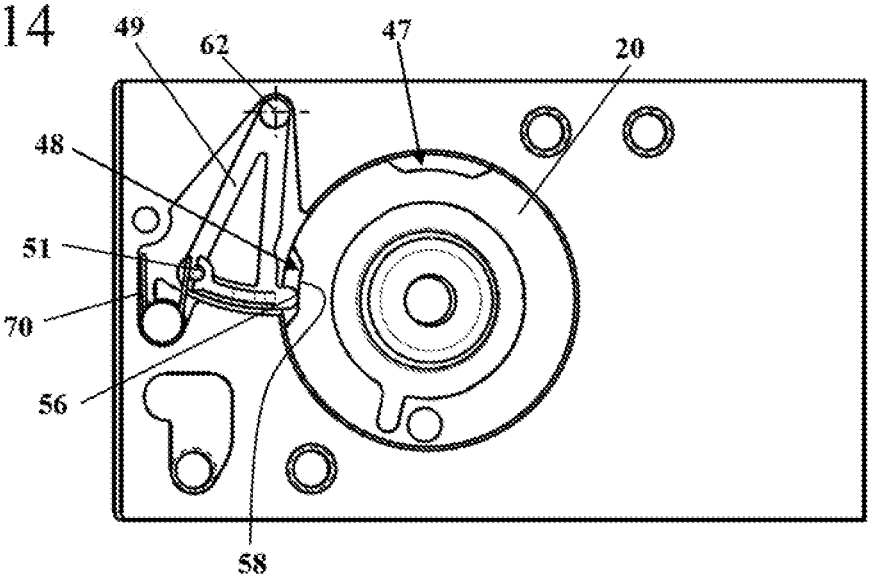
FIG. 14 shows a top view of the carburetor with the carburetor drum from FIGS. 4 to 7 in the full load position.
Figure 15:
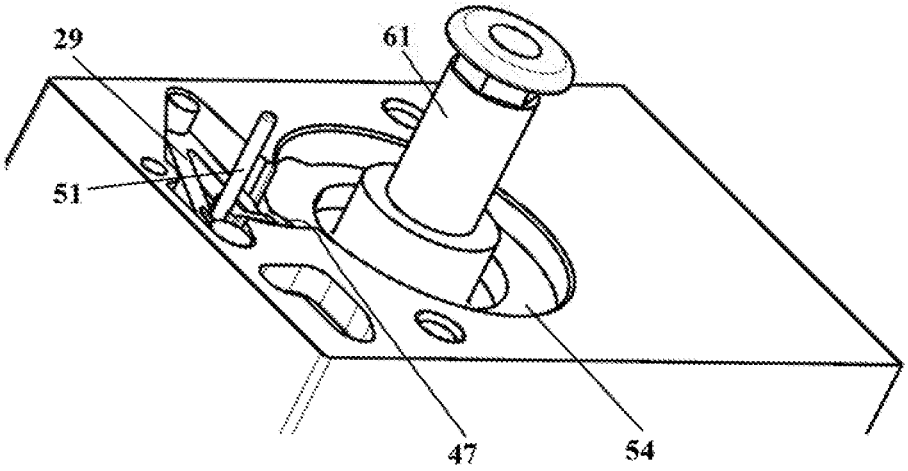
FIG. 15 is a schematic perspective illustration of the carburetor in the position from FIG. 14; and, FIG. 16 is a circuit diagram of the sensing unit and of a control device of the combustion engine.

FIGS. 14 and 15 show the arrangement in the full gas position. The full gas position refers to the operation of the combustion engine 1 during full gas, that is, an operating state in which the combustion engine 1 is running and a user steps on the gas and, for example, the operator-controlled element 42 is completely depressed (FIG. 1). In the full gas position, the sensing device 56 lies against the base 58 of the second depression 48. As a result, the pivot lever 49 has pivoted back about the pivot axis 62. The resetting of the pivot lever 49 takes place on the basis of a return spring 70 which is illustrated in FIG. 14. The return spring 70 is connected to the contact pin 51 in each position of the pivot lever 49. The ground contact is produced via the return spring 70. In the pivoted-back position of the pivot lever 49, the contact pin 51 is not contacted by the spring 50 (corresponding to FIG. 8). The switch 22 is open.

In the full gas position shown in FIGS. 14 and 15, the cross sections of first supply channel 8 and second supply channel 9 are completely open. In the full gas position, the cross sections of first supply channel 8 and second supply channel 9 are advantageously not reduced by the carburetor drum 20.

The figures show two slightly different configurations of the depressions 47 and 48 and of the spring 50. In the embodiment according to FIGS. 8 and 11, the depressions 47 and 48 have an incline 79, 80, via which the actuating means comes into the partial load position during the adjustment from the idle running position and during the adjustment from the partial load position into the full load position, only at the sides. On the opposite side, the wall has a rounded and steep profile, and therefore the actuating means on the side which is remote from the other depression 47, 48 cannot emerge from the depressions 47 and 48. This is customarily prevented in any case via corresponding stops of the carburetor drum 20, which stops set the idle running position and the full load position.

As FIG. 6 shows, the depressions 47 and 48 can have a differing geometry. However, the depressions 47 and 48 can also have an identical geometry and can be arranged mirror-symmetrically, as FIG. 8 shows. In the case of depressions 47 and 48 having differing geometry, one of the depressions 47, 48, for example, can be configured to be deeper, longer, more rounded or more angular than the other of the depressions 47, 48. It can also be provided that the inclines 59, 79, 80 and/or 81 differ in configuration. For example, one incline 79, 80 can be configured as an incline and the contour arranged at the other end of the depression 47, 48 can be configured as a sharp edge. Other geometries, for example radii, may also be advantageous. Alternatively or additionally, the depressions 47 and 48 can have, for example, different depths. The differing configurations can be used by the sensing unit 55 to identify the different positions. The differing configurations can also be used in order to be able to identify unambiguous positions of the carburetor drum 20 during the manufacturing. Alternatively, for the sensing of the different switching positions, use may also be made, for at least one switching position, of an alternative position identification, for example a lever in combination with a potentiometer.

Figure 16:
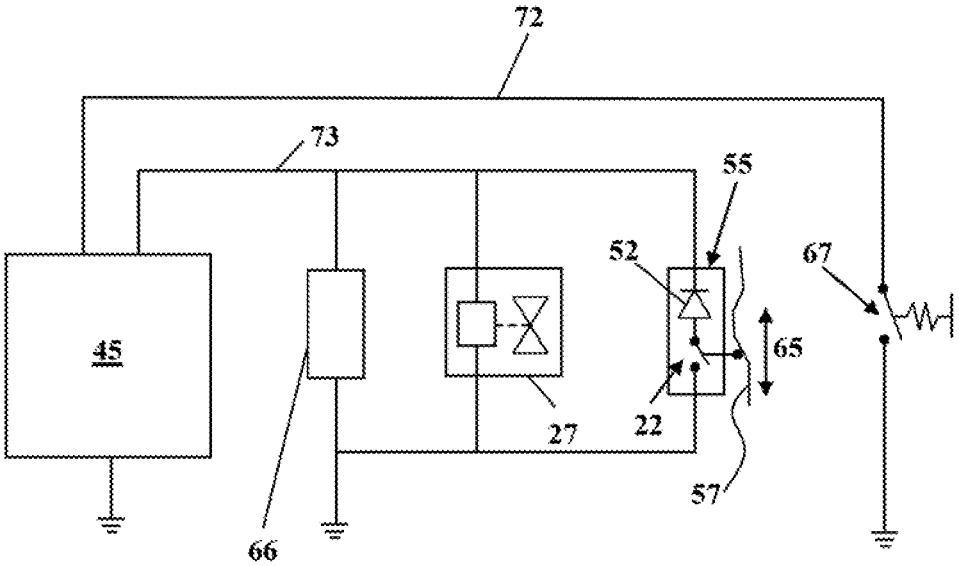

FIG. 16 schematically shows a circuit diagram of the arrangement. The control device 45 is connected to a short circuit button 67 via a line 72. The control device 45 advantageously has a microprocessor. The short circuit button 67 is to be actuated by the operator and can also be configured as a switch. The short circuit button 67 serves to short circuit the ignition of the combustion engine 1 (FIG. 2) and to thereby switch off the combustion engine 1. The control device 45 is connected via a further line 73 to a connection 66 for a diagnostic device, and to the fuel valve 27 and the diode 52 and the switch 22. The connection 66 for the diagnostics, the fuel valve 27 and the switch 22 are advantageously connected in parallel. The switch 22 is opened or closed depending on the position of the control contour 57. The movement of the control contour 57 is indicated schematically by an arrow 65 in FIG. 16.

It is provided in the embodiment that the switch 22 is open in the idle running state and in the full load state and is closed in the partial load state located in-between. It is provided that the control device 45 controls the quantity of fuel supplied via the fuel valve 27 depending on the rotational position, which is determined by the sensing unit 55, of the carburetor drum 20. In the embodiment, the sensing unit 55 is formed by the switch 22, the sensing device 56, the control contour 57 and the diode 52.

In an alternative configuration, it can be provided that, in the event of a rotational position of the carburetor drum 20 between the idle running position and the full load position, the sensing device 56 does not lie against the outer peripheral surface 60 of the carburetor drum 20 on the carburetor drum 20, but rather against a curved surface, the radius of which about the pivot axis 35 of the carburetor drum 20 differs from that of the outer peripheral surface 60, and which is therefore arranged closer to the pivot axis 35 of the carburetor drum 20 or further away from the pivot axis 35.

Further advantageous embodiments emerge from any desired combination of the embodiments described.

It is understood that the foregoing description is that of the preferred embodiments of the invention and that various changes and modifications may be made thereto without departing from the spirit and scope of the invention as defined in the appended claims.

What is claimed is:

1. A carburetor for the combustion engine in a handheld work apparatus, the carburetor comprising:

a carburetor housing;

a carburetor drum mounted rotatably about a pivot axis in said carburetor housing;

said carburetor drum having a drum body;

said drum body defining at least one channel which runs transversely with respect to the pivot axis and forms an intake channel portion;

a sensing unit for sensing at least one rotational position of said carburetor drum, wherein said sensing unit is configured to generate an electrical signal;

said sensing unit including a control contour and a sensing device configured to interact with said control contour; and, said control contour being formed on said carburetor drum.

2. The carburetor of claim 1, wherein said control contour is arranged on said drum body.

3. The carburetor of claim 2, wherein:

said drum body has a region with a largest diameter thereof; and, said control contour is arranged in said region of said drum body with said largest diameter.

4. The carburetor of claim 1, wherein:

said drum body includes a cylindrical section defining an outer periphery; and, said control contour includes at least one depression on said outer periphery of said cylindrical section of said drum body.

5. The carburetor of claim 4, wherein:

said control contour has a first depression which is assigned to idle running; and, said control contour has a second depression which is assigned to full load.

6. The carburetor of claim 1, wherein:

said carburetor drum defines a circumference and an outer peripheral surface;

said control contour includes a depression on said circumference of said carburetor drum; and, said depression has a base which bounds said depression in a radial direction and merges on at least one side, lying in a peripheral direction, of said depression with an incline into said outer peripheral surface of said carburetor drum.

7. The carburetor of claim 1, wherein said sensing device rests against said control contour radially outside said control contour with respect to the pivot axis for sensing said at least one rotational position of said carburetor drum.

8. The carburetor of claim 1 further comprising:

a return spring; and, said sensing device being spring-loaded radially inwardly with respect to the pivot axis by said return spring.

9. The carburetor of claim 1, wherein said sensing unit includes a switch which is actuated depending on the position of said sensing device and is configured to generate said electrical signal.

10. The carburetor of claim 1, wherein the pivot axis is a first pivot axis, the carburetor further comprising:

a pivot lever mounted on said carburetor housing so as to be pivotable about a second pivot axis lying parallel to said first pivot axis; and, said sensing device being formed on said pivot lever.

11. The carburetor of claim 8, wherein the pivot axis is a first pivot axis, the carburetor further comprising:

a pivot lever mounted on said carburetor housing so as to be pivotable about a second pivot axis lying parallel to said first pivot axis;

said sensing device being formed on said pivot lever; and, said pivot lever being connected to ground via said return spring.

12. The carburetor of claim 1 further comprising a fuel valve via which fuel is fed into said at least one channel of said carburetor drum.

13. A combustion engine comprising:

a carburetor having a carburetor housing and a carburetor drum mounted rotatably about a pivot axis in said carburetor housing;

said carburetor drum having a drum body;

said drum body having at least one channel which runs transversely with respect to the pivot axis and forms an intake channel portion;

said carburetor including a sensing unit for sensing at least one rotational position of the carburetor drum;

said sensing unit being configured to generate an electrical signal when said carburetor drum is in said at least one rotational position;

said sensing unit including a control contour and a sensing device configured to interact with said control contour;

said control contour being formed on said carburetor drum;

a fuel valve via which fuel is fed into said channel of said carburetor drum;

a control device being connected to said sensing unit;

said control device being configured to receive said electrical signal generated by said sensing unit as a received signal; and, said control device being connected to said fuel valve and configured to control an amount of fuel to be supplied to said at least one channel in dependence upon said received electrical signal.

14. A method for operating a combustion engine having a carburetor, the carburetor having a carburetor housing and a carburetor drum mounted rotatably about a pivot axis in the carburetor housing, the carburetor drum having a drum body, the drum body having at least one channel which runs transversely with respect to the pivot axis and forms an intake channel portion, the carburetor including a sensing unit for sensing at least one rotational position of the carburetor drum, the sensing unit being configured to generate an electrical signal, the sensing unit including a control contour and a sensing device interacting with the control contour, the control contour being formed on the carburetor drum, the carburetor further having a fuel valve via which fuel is fed into the channel of the carburetor drum, the combustion engine having a control device which is connected to the sensing unit and to the fuel valve for feeding fuel into the intake channel portion, the method comprising the steps of:

sensing a rotational position of the carburetor drum via the sensing unit via a generation of an electrical signal in dependence upon a rotational position of the carburetor drum;

transmitting the electrical signal to the control device; and, controlling, via the control device, a supplied quantity of fuel in dependence upon the electrical signal transmitted by the sensing unit.

* * * * *